US006159115A

United States Patent [19]

Hsu

[11] Patent Number: 6,159,115

[45] Date of Patent: Dec. 12, 2000

[54] HANDLE STRUCTURE FOR A RACKET

[76] Inventor: Young-Chen Hsu, No.121, Sec.1, Shen Lin Rd., Taya Hsiang, Taichung Hsien, Taiwan

[21] Appl. No.: 09/449,960

[22] Filed: Nov. 26, 1999

[51] Int. Cl.[7] ..... A63F 49/08

[52] U.S. Cl. ..... 473/549; 473/519

[58] Field of Search ..... 473/549, 550, 473/551, 552, 519, 297, 559, 560, 564, 47, 338; 16/110.1; 81/489, 490

[56] References Cited

U.S. PATENT DOCUMENTS

| | | | |
|---|---|---|---|
| 692,970 | 2/1902 | Zaehringer | 473/47 |
| 4,043,563 | 8/1977 | Churchward | 473/338 |
| 4,936,586 | 6/1990 | Van Raemdonck | 473/519 |
| 5,069,452 | 12/1991 | Chen | 473/549 |
| 5,326,329 | 7/1994 | Doss | 473/47 |
| 5,766,088 | 6/1998 | Severtsen | 473/297 |
| 5,865,694 | 2/1999 | Duong-Van | 473/549 X |
| 6,086,489 | 7/2000 | Hsu | 473/549 |
| 6,089,994 | 7/2000 | Sun | 473/338 |
| 6,089,996 | 7/2000 | Hsu | 473/549 X |

*Primary Examiner*—Raleigh W. Chiu
*Attorney, Agent, or Firm*—Rosenburg, Klein & Lee

[57] ABSTRACT

A handle for a racket includes a handle part from which an engaging section longitudinally extends. A carrier member is mounted to the engaging section and has a plurality of weights received in an outside and/or an end thereof A butt cap is mounted to the carrier member. The carrier member can be replaced with another one having different length so as to change the length of the handle. The numbers and positions of the weights in the carrier member can be adjusted so as to adjust the position of weight of the handle.

8 Claims, 4 Drawing Sheets

HANDLE STRUCTURE FOR A RACKET

FIELD OF THE INVENTION

The present invention relates to a handle for a racket. The handle has a carrier member which has a plurality of holes defined therein so as to receive weights to change the point of weight of the racket.

BACKGROUND OF THE INVENTION

A conventional tennis racket generally includes a handle and a head with a shank connected between the head and the handle. The head has a plurality of strings so as to form a area to hit the tennis ball. The handle generally is a polygonal tube with grip wrapped around thereto so as to be firmly held by the users. A butt cap is connected to the end of the handle. The conventional handle has a fixed length and a fix position of weight, both of which are not adjustable. In other words, the user has to carefully choose the racket that meet his/her needs. The requirements of the racket for an attack type player and a defense player are different so that the players will choose the rackets with different features. Nevertheless, the strategy is decided according the opposite player, so that a player needs at least two rackets having two different features.

The present invention intends to provide a handle for a tennis racket wherein the length and the position of weight of the handle can be adjustable so that the racket can be used by different users and in different strategies.

SUMMARY OF THE INVENTION

In accordance with one aspect of the present invention, there is provided a handle for a racket and comprising a handle part with an engaging section extending longitudinally from the handle part. A carrier member is mounted to the engaging section and has a plurality of holes are defined therein so as to receive weights in the holes. A butt cap is mounted to the carrier member.

The object of the present invention is to provide a handle for a racket wherein the handle has a carrier member received therein and a plurality of weights are received in the carrier member so that the position of the weight can be varied by adding or removing the weights.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
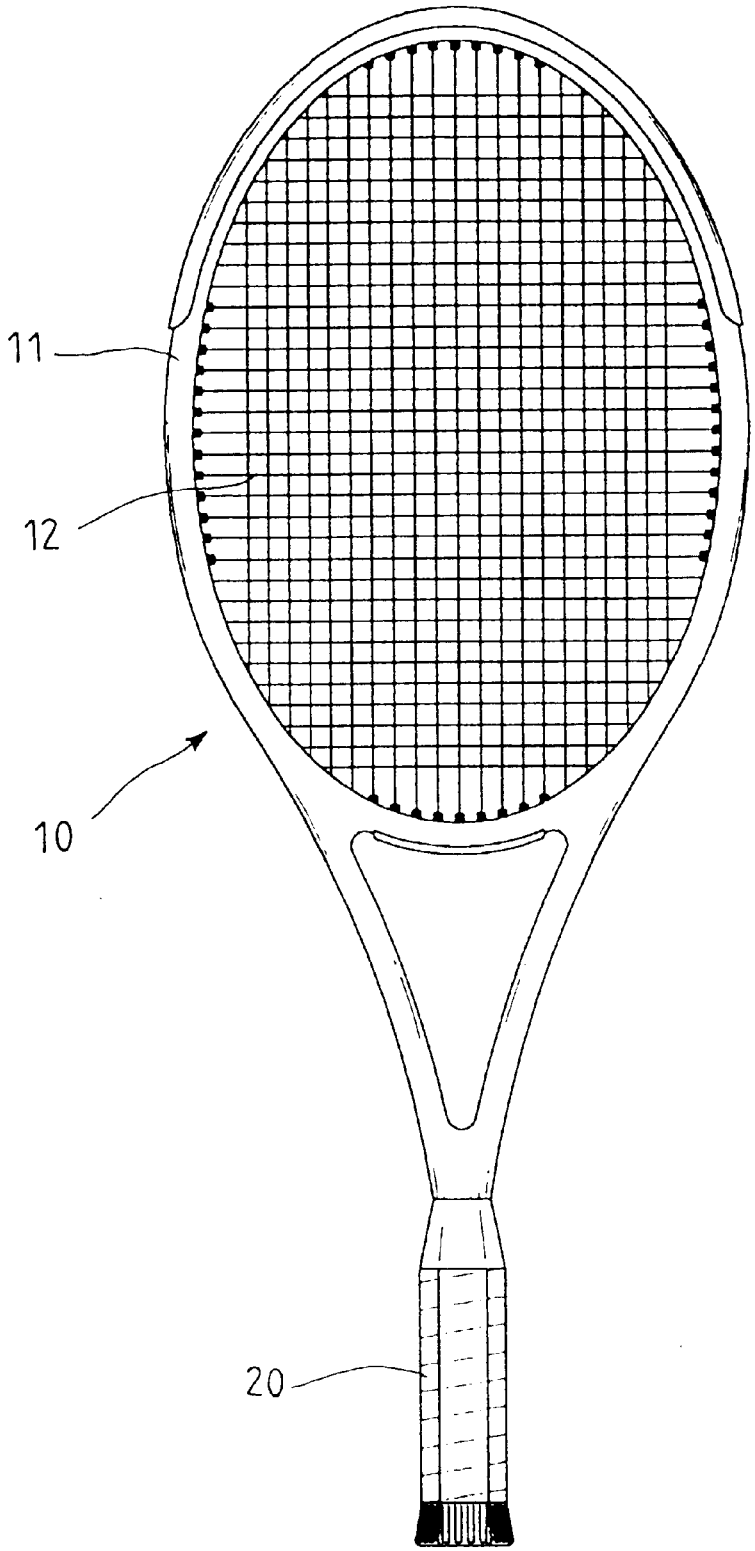
FIG. 1 is a plan view to show a tennis racket having a handle of the present invention.
Figure 2:
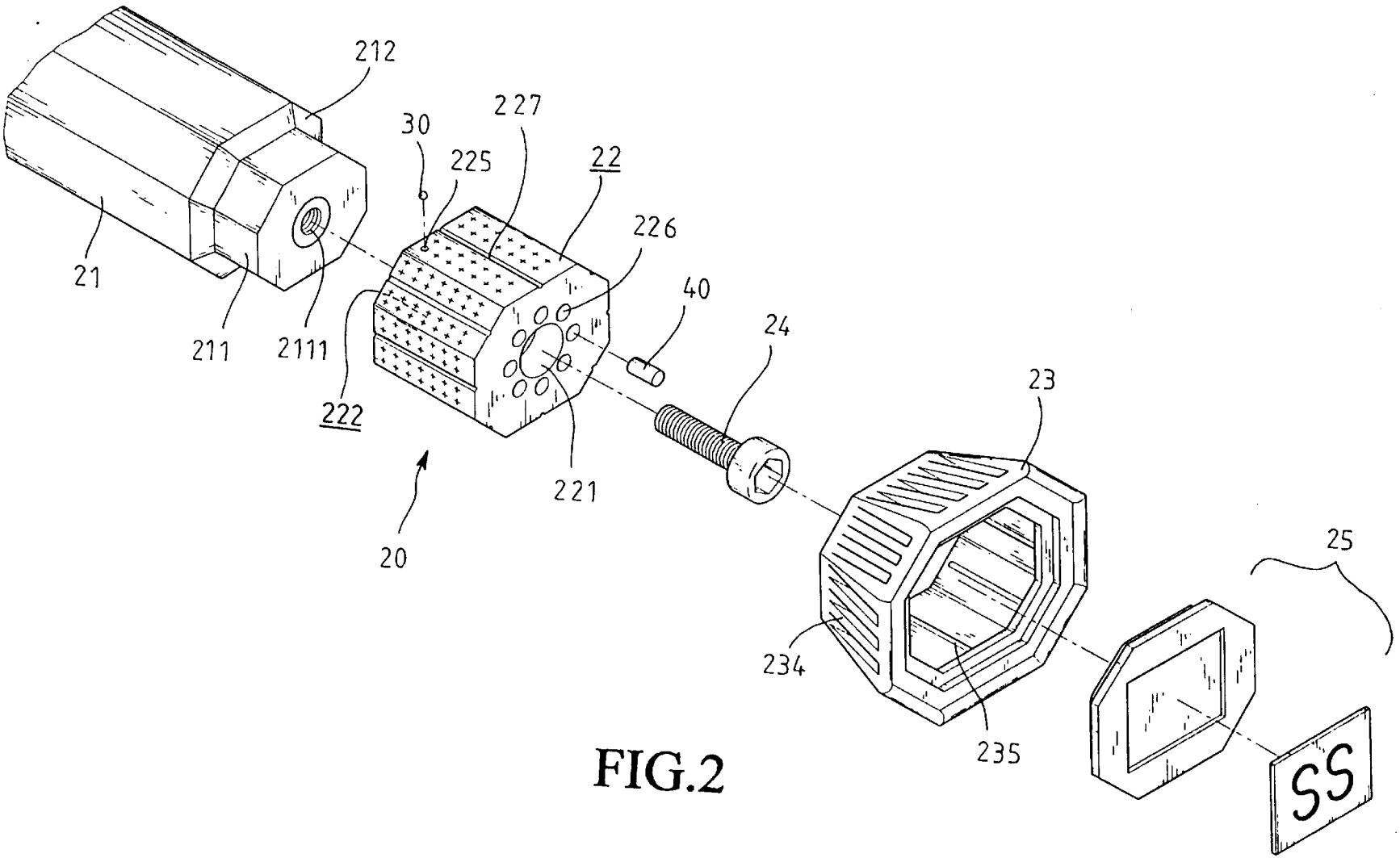
FIG. 2 is an exploded view to show the carrier member, the butt cap and the handle part of the handle of the present invention.
Figure 4:
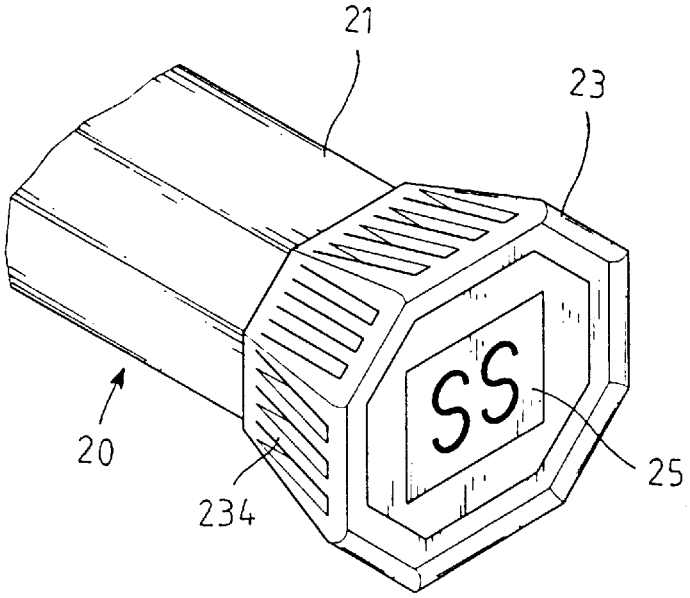
FIG. 4 is a perspective view to show the handle with the butt cap of the present invention.

Referring to FIGS. 1, 2, and 4, a tennis racket 10 includes a head 11 with strings 12 engaged within the head 11, a handle 20 and a shank portion 200 connected between the head 11 and the handle 20. The handle 20 in accordance with the present invention comprises a handle part 21 and an engaging section 211 extends longitudinally from the handle part 21. A tapered ramp portion 212 is connected between the engaging section 211 and the handle part 21.

A carrier member 22 is removably mounted to the engaging section 211. The carrier member 22 has a closed end and an open end 222 in which the engaging section 211 is received. The open end 222 of the carrier member 22 has a tapered edge 223 which matches with the tapered ramp portion 212. The closed end 222 has a plurality of first holes 226 defined therethrough so as to receive weights 40 therein. A plurality of grooves 227 are defined in an outside of the carrier member 22 and the butt cap 23 has a plurality of first ribs 235 extending radially inward from an inside thereof so that the first ribs 235 are engaged with the grooves 227. The engaging section 211 has a threaded hole 2111 and the butt cap 23 has a passage 231 so that a bolt 24 extends through the passage 231, the central hole 221 in the carrier member 22 and is engaged with the threaded hole 2111 to secure the butt cap 23 in position. A recess 233 is defined in a distal end of the butt cap 23 and a decoration plate 25 is engaged with the recess 233. The butt cap 23 further has a plurality of soft wings 234 extending radially outward from an outside thereof.

Figure 3:
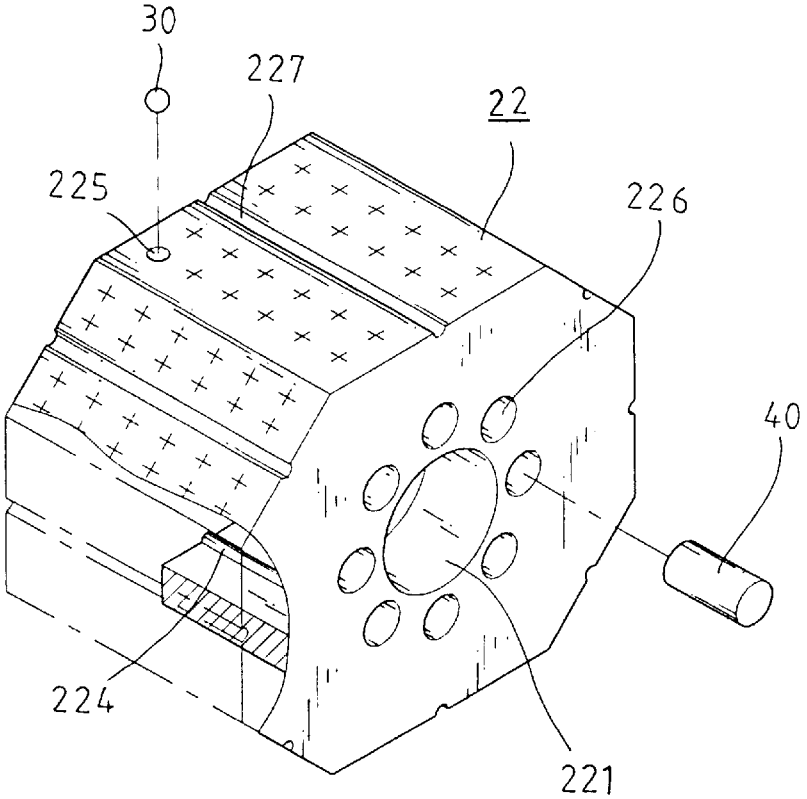
FIG. 3 shows the structure of the another embodiment of the carrier member of the present invention.

FIG. 3 shows another type of the carrier member 22 wherein a plurality of second holes 225 are defined through an outside of the carrier member 22 so as to receive weight 30 therein. A plurality of second ribs 224 extend radially inward from 20 an inside of the carrier member 22 so that when the carrier member 22 is mounted to the engaging section 211, the second ribs 224 enhances the engagement between the carrier member 22 and the engaging section 211.

Figure 5:
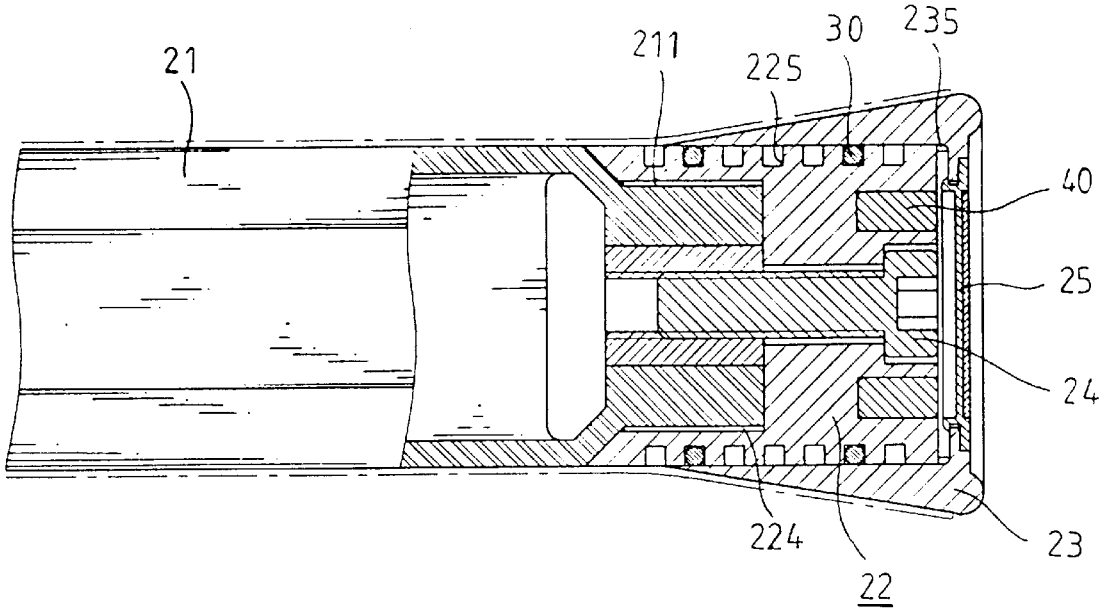
FIG. 5 is a cross-sectional view to show the handle of the present invention.
Figure 6:
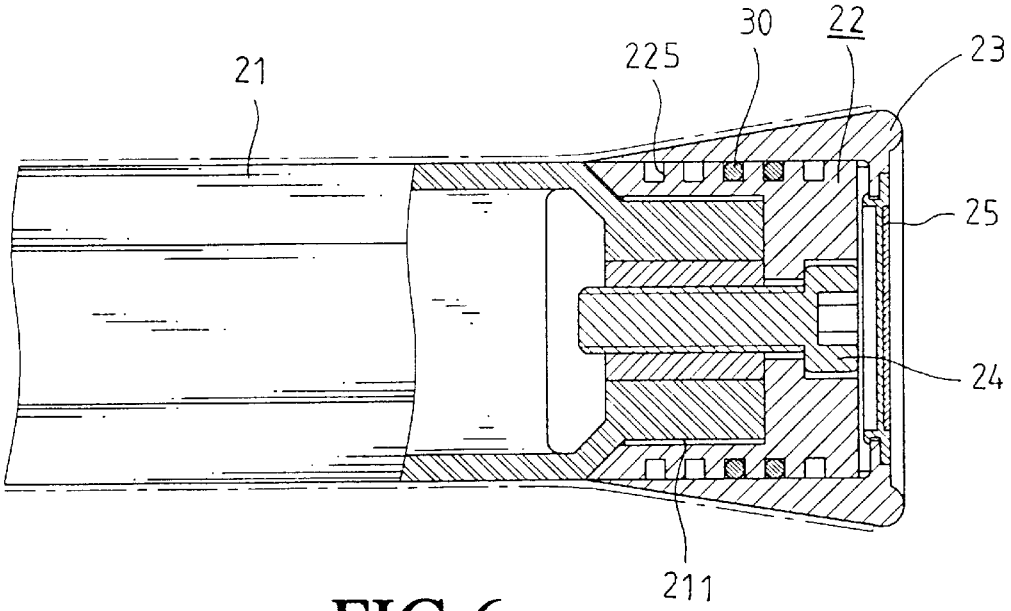
FIG. 6 is a cross-sectional view to show the handle of the present invention, wherein the carrier member is replaced by a shorter one and the positions of the weights are changed.

The carrier member 22 may include the first holes 226 and the second holes 225 as described above. As shown in FIG. 5, the positions of the weights 30 can be changed according to the users' needs. A shown in FIG. 6, the carrier member 22 can also be replaced by a shorter one so as to change the length of the handle 20 of the racket 10.

The numbers and positions of the weights 30 and 40 can be adjusted to that the users can obtain the right racket 10 that completely meets the users' requirements.

While we have shown and described various embodiments in accordance with the present invention, it should be clear to those skilled in the art that further embodiments may be made without departing from the scope and spirit of the present invention.

What is claimed is:

1. A handle for a racket, comprising:

handle part and an engaging section extending longitudinally from said handle part;

a carrier member removably mounted to said engaging section and having a plurality of holes defined therein, at least one weight received in one of said holes, and a butt cap mounted to said carrier member.

2. The handle for a racket as claimed in claim 1, wherein said engaging section has a threaded hole and said butt cap has a passage so that a bolt extends through said passage and is engaged with said threaded hole.

3. The handle for a racket as claimed in claim 2 further comprising a tapered ramp portion connected between said engaging section and said handle part, said open end of said carrier member having a tapered edge which matches with said tapered ramp portion.

4. The handle for a racket as claimed in claim 1, wherein said carrier member has a closed end and an open end in which said engaging section is received, said closed end having a plurality of first holes defined therethrough so as to receive said at least one weight.

5. The handle for a racket as claimed in claim 1 further comprising a plurality of second holes defined through an outside of said carrier member so as to receive said at least one weight.

6. The handle for a racket as claimed in claim 1 further comprising a plurality of first ribs extending radially inward from an inside of said carrier member.

7. The handle for a racket as claimed in claim 1 further comprising a plurality of grooves defined in an outside of said carrier member, a plurality of second ribs extending radially inward from an inside of said butt cap so that said second ribs are engaged with said grooves.

8. The handle for a racket as claimed in claim 1 further comprising a recess defined in a distal end of said butt cap and a decoration plate engaged with said recess.

* * * * *